US009743744B2

(12) United States Patent
Maier et al.

(10) Patent No.: US 9,743,744 B2
(45) Date of Patent: Aug. 29, 2017

(54) MODULE RETAINER

(75) Inventors: Matthias Maier, Heiningen (DE); Markus Hetzel, Grafenau (DE)

(73) Assignee: KONIKLIJIKE PHILIPS N.V., Eindhoven (NL)

( * ) Notice: Subject to any disclaimer, the term of this patent is extended or adjusted under 35 U.S.C. 154(b) by 869 days.

(21) Appl. No.: 13/522,509

(22) PCT Filed: Jan. 24, 2011

(86) PCT No.: PCT/IB2011/050300

§ 371 (c)(1),
(2), (4) Date: Jul. 17, 2012

(87) PCT Pub. No.: WO2011/092621

PCT Pub. Date: Aug. 4, 2011

(65) Prior Publication Data

US 2012/0286004 A1 Nov. 15, 2012

(30) Foreign Application Priority Data

Jan. 28, 2010 (EP) ..... 10151914

(51) Int. Cl.
*A45F 5/02* (2006.01)
*A45C 13/10* (2006.01)

(52) U.S. Cl.
CPC ..... *A45F 5/02* (2013.01); *A45C 13/1084* (2013.01); *A45F 5/021* (2013.01); *A45F 2200/0516* (2013.01)

(58) Field of Classification Search
USPC ..... 224/163, 663–675; 24/168, 170, 191, 24/3.12, 3.1; 2/336, 338, 340, 342; 248/226.11, 231.51, 510
See application file for complete search history.

(56) References Cited

U.S. PATENT DOCUMENTS

| | | | | |
|---|---|---|---|---|
| 4,285,554 | A * | 8/1981 | Bell et al. | 312/9.63 |
| 4,828,153 | A | 5/1989 | Guzik et al. | |
| 4,936,499 | A * | 6/1990 | Gulley | 224/669 |
| 5,528,770 | A * | 6/1996 | Castilla et al. | 340/7.63 |
| 6,251,080 | B1 | 6/2001 | Henkin et al. | |
| 6,344,025 | B1 | 2/2002 | Inagaki et al. | |
| 6,889,879 | B2 | 5/2005 | Rivera et al. | |
| 7,131,214 | B1 * | 11/2006 | Blackman et al. | 33/761 |
| 2005/0171444 | A1 | 8/2005 | Ono et al. | |
| 2007/0226958 | A1 | 10/2007 | Clifton, Jr. | |
| 2009/0124459 | A1 * | 5/2009 | Methot | 482/1 |

FOREIGN PATENT DOCUMENTS

JP 11042216 A 2/1999

* cited by examiner

*Primary Examiner* — Adam Waggenspack

(57) ABSTRACT

The module retainer (1) for accommodating a functional module comprises a clamp (20) for attaching the module retainer (1) to a supporting belt (2). The clamp (20) has a first side (21) that is pivotally attached to a main structure (10) of the module retainer (1). The module retainer (1) further comprises at least one snap-fit (12) for operably attaching a second side (22) of the clamp (20) to the main structure (10) and for fixing the clamp (20) in a closed position in which the supporting belt (2) is embraced. The snap-fit (12) is designed and positioned such that it gets obstructed by a functional module (3) inserted in the main structure (10) of the module retainer (1) and secures the clamp (20) in the closed position.

13 Claims, 3 Drawing Sheets

MODULE RETAINER

FIELD OF THE INVENTION

The invention relates to a module retainer for accommodating a functional module, and in particular for a module retainer that is attachable to a supporting belt. The invention further relates to a system comprising a module retainer and a functional module.

BACKGROUND OF THE INVENTION

In medical care, functional modules, for example for determining physiological parameter of a patient, are often attached to the body of a patient with a supporting belt. An example is a mobile blood pressure monitor that is attached to a patient's arm wrist or upper arm with an inflatable belt, also referred to as a cuff. For hygienic reasons and for easier maintenance, it is desirable to be able to separate the functional module from the supporting belt.

U.S. Pat. No. 6,344,025 B1 describes a blood pressure monitor with a cuff and a detachable functional module. The cuff is equipped with a module retainer that is firmly and inseparably coupled to the cuff. The module and the module retainer are equipped with a quick lock system for easily attaching and detaching the functional module to and from the module retainer.

Even if that way the functional module can be easily separated from the module retainer and accordingly the cuff, the module retainer remains coupled to the cuff. In particular for functioning modules that are used in combination with deposable belts, this is not desirable for economical reasons. For reusable belts, the different material of belt and module retainer complicates cleaning and sanitization.

It would therefore be advantageous to achieve a module retainer for accommodating a functional module, where the module retainer can be easily and securely affixed to a supporting belt in order to provide an assured support for an inserted functional module, and where, at the same time the module retainer can be easily detached from the supporting belt when not in use.

SUMMARY OF THE INVENTION

The present application contemplates a module retainer for accommodating a functional module that comprises a clamp for attaching the module retainer to supporting belt. The clamp has a first side that is pivotally attached to a main structure of the module retainer. The module retainer furthermore comprises at least one some snap-fit for operably attaching a second side of the clamp to the main structure of the module retainer and fixing the clamp in a closed position in which the supporting belt is embraced. The snap-fit is designed and positioned such that it is obstructed by a functional module inserted in the main structure of the module retainer and accordingly secures the clamp in the closed position.

By the combination a pivotable clamp that engages with the at least one snap-fit, the module retainer according to the invention is provided with a mechanism for easily attaching the module retainer to a supporting belt and for easily separating it from the supporting belt. No permanently fixed elements have to be coupled to the supporting belt, which makes the module retainer well suited for use with simple and cheap disposable belts. For an assured and firm coupling of the module retainer to the supporting belt, the snap-fit is designed and positioned in such a way, that it gets obstructed by an inserted functional module. That way, a further securing mechanism which would at weight and costs can be omitted. Furthermore, no extra handling step is necessary to secure the coupling between the module retainer and the supporting belt once the functional module is inserted.

In an advantageous embodiment, the main structure of the module retainer is frame like and comprises side walls and a base, the side walls and the base enclosing a volume for accommodating an inserted functional module. In a particular advantageous embodiment, the at least one snap-fit penetrates at least partially into the volume for accommodating an inserted functional module when operated. This way, an obstruction of the at least one snap-fit is achieved without needing any additional mechanical elements.

The present application further contemplates a system comprising a module retainer for accommodating a functional module and a respective functional module. The advantages correspond to the advantages of the aforementioned module retainer.

Further advantageous embodiments are provided in the respective dependent claims. Still further advantages and benefits of the present invention will become apparent from and elucidated with reference to the embodiments described hereinafter in connection with the drawings.

DETAILED DESCRIPTION OF EMBODIMENTS

Figure 1:
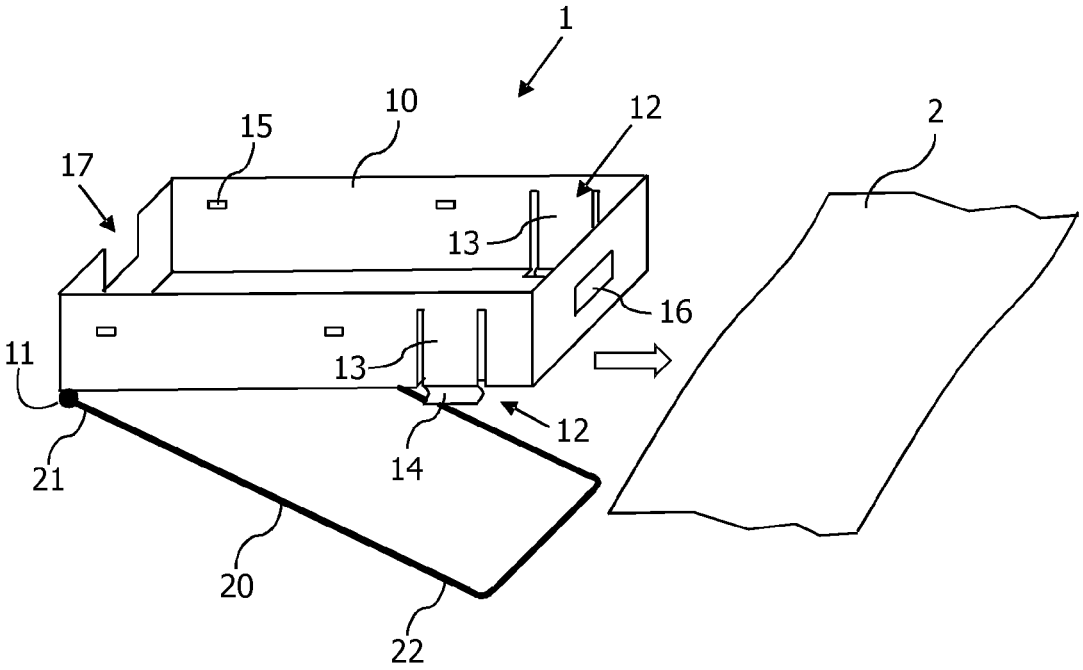
FIG. 1 shows a first embodiment of a module retainer detached from a supporting belt in a schematic perspective view.

FIG. 1 shows a first embodiment of a module retainer 1 adjacent to, but not attached to a supporting belt 2.

The module retainer 1 comprises a main structure 10 that is frame-like with side walls and a base. The top side opposite the base is open. Side walls and base enclose a volume for the receiving a functional module not shown in this figure.

By way of example, the module retainer 1 is designed to receive a blood pressure monitor as the functional module. The blood pressure monitor is connected to a cuff that can be wrapped around a limb of a patient via at least one pressure hose. The blood pressure monitor is usually designed to automatically inflate and deflate the cuff while performing the measurement. For a compact design and an easy usage the module retainer 1 is supported by the cuff. In one embodiment, the supporting belt 2 is a separate strap that is attached to the cuff and that is particularly dedicated to carry the module retainer 1. In an alternative embodiment, the module retainer 1 can be attached to the cuff directly. In this respect, the cuff itself would act as the supporting belt 2.

The main structure 10 of the module retainer 1 comprises two bearings 11 attached to one side of the base plate. Only one of the two bearings 11 is visible in FIG. 1. At the lengthwise opposite side of the main structure 10, two snap-fits 12 are provided. Details of the bearings 11 and the snap-fits 12 are described below.

Small openings acting as retaining elements 15 for locking an inserted functional module in place are formed in the side walls of the main structure 10. In the embodiment shown, four retaining elements 15 are present, of which only one is tagged with a reference numeral for enhanced clarity of the illustration. Furthermore, the side walls of the main structure 10 have an opening 16 and a cut out 17. The opening 16 gives access to connectors of an inserted functional module, for example electrical or pneumatical connectors. The cut out 17 allows grasping an inserted functional module for lifting and detaching it from the module retainer. Cut outs are also provided in the base of the main structure 10 adjacent to the snap-fits 12 to create a moving space for the notches 14. This space is needed when the snap-fits are operated and bent inwards. The base of the main structure 10 could also be provided with further cut outs or openings, for example for accessing the skin of a patient with sensors, for example electrical, optical or acoustical sensors, through openings in the belt or through the belt 2 itself.

The module retainer 1 further comprises a clamp 20, a first side 21 of which is pivotally coupled to the main structure 10. In the embodiment shown, the clamp 20 is made from a U-shaped bent wire with both legs bent inwards at the first side 21. The bent off parts of the clamp 20 are inserted into the bearing 11 and are thus invisible in FIG. 1. The bearing 11 is essentially a hole or a stud hole, for example formed in a tube-like element integrally molded to the main structure 10.

When rotated towards the main structure 10, a second side 22 of the clamp 20 interacts and engages with the snap-fits 12. In the embodiment shown, each one of the snap-fits 12 includes an elastic part 13 and a notch 14. Each snap-fit 12 essentially constitutes of a part of the side wall of the main structure 10, ripped out by vertical gaps in the side wall. It remains connected to the main structure 10 at its side opposite of the base, such that an elastic tongue is created as the elastic part 13. The notch 14 is formed at the tip of the tongue.

If laterally positioned between the bearings 11 and the snap-fits 12, the belt 2 can be clamped between the base of the main structure 10 and the clamp 20 by engaging the clamp 20 with the snap-fits 12, such that the second side 22 of the clamp 20 snaps into the notches 14 of the snap-fits 12. In the following, the position in which the clamp 20 is locked in the snap-fits 12 is referred to as the closed position. In the closed position, the belt 2 is embraced by the main structure 10 and the clamp 20 in a direction vertical to the base of the main structure, and by the bearings 11 and the snap-fits 12 in direction perpendicular to the vertical direction.

Figure 2:
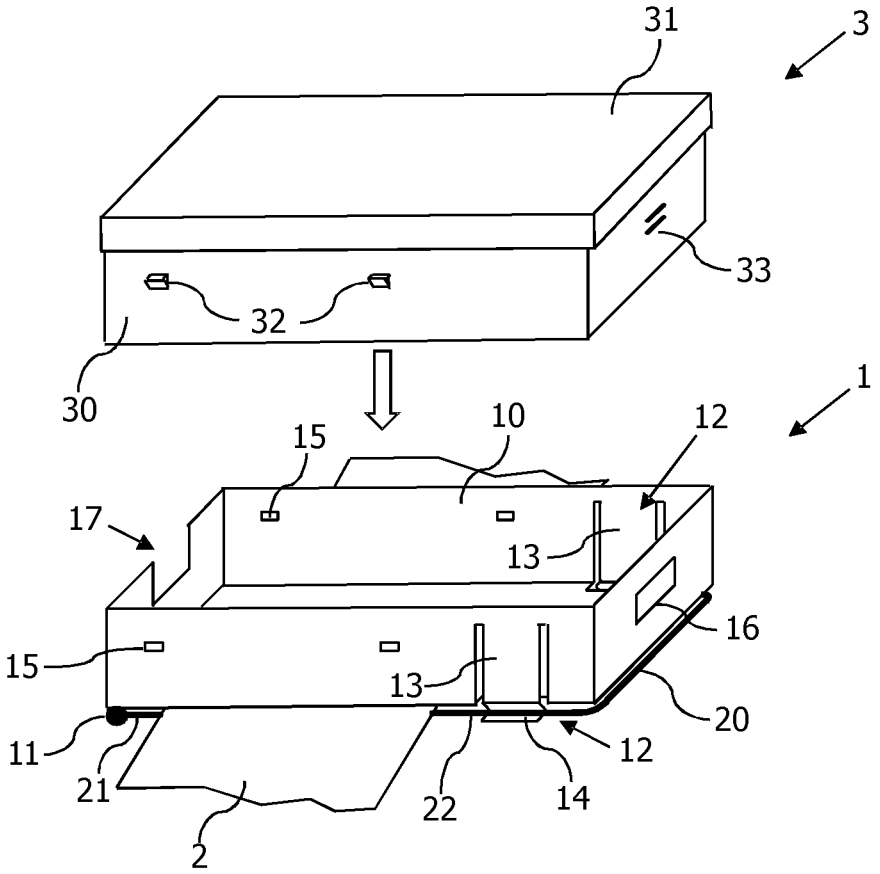
FIG. 2 shows the module retainer according to FIG. 1 attached to the supporting belt and a functional module separated from the module retainer.

FIG. 2 shows the module retainer 1 attached to the belt 2 with the clamp 20 being in the closed position. FIG. 2 further shows a functional module 3 for insertion into the module retainer 1.

The functional module 3 comprises a housing 30 with a lid 31. Complementary retaining elements 32 that can interact with the retaining elements 15 of the module retainer 1 are formed on the side walls of the housing 30. The functional module 3 furthermore comprises a connection port 33 on a front wall of the housing 30.

In the situation shown in FIG. 2, where the functional module 3 is not yet inserted into the module retainer 1, the module retainer 1 can be taken off the belt 2 again by pressing the elastic parts 13 of the snap-fits 12 and bending these inwards. Accordingly, the notches 14 release the clamp 20 from the closed position. When being pressed and bent inwards, the snap-fits 12 penetrate at least partially into the volume provided for receiving the functional module 3.

Figure 3:
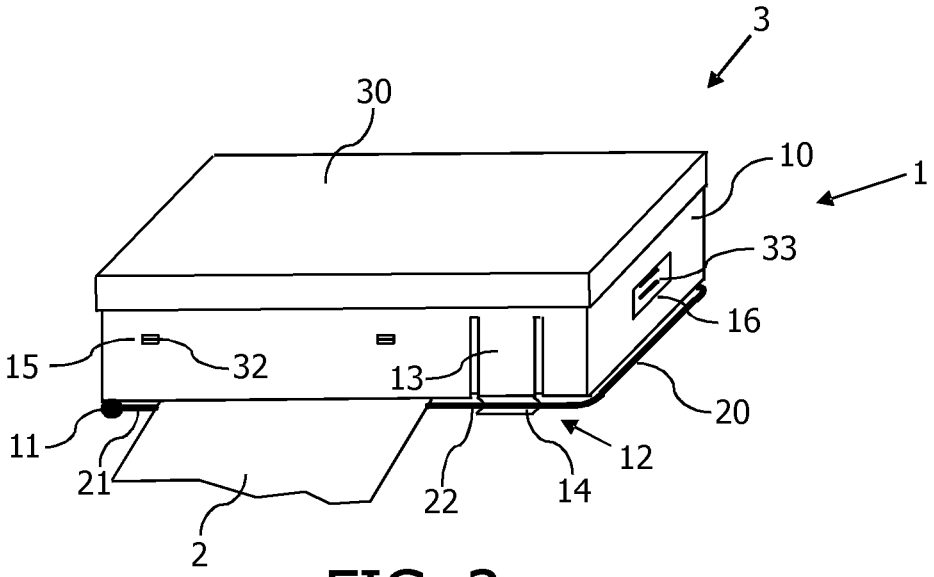
FIG. 3 shows the module retainer attached to the supporting belt according to FIG. 2 with the functional module inserted in the module retainer.

FIG. 3 shows the module retainer 1 attached to the belt 2 with the functional module 3 being inserted into the module retainer 1. The functional module 3 is shaped to essentially fill the entire volume that the module retainer 1 provides for the functional module. It fills in particular the part of the volume directly behind the snap-fits 12. When inserted, the complementary retaining elements 31 of the functional module 3 engage with the retaining elements 15 of the main part 10 of the module retainer 1. In the embodiment shown, the retaining elements 15 are openings in the walls of the main part 10 and the complementary retaining elements 32 are small noses integrally formed on the surface of the housing 30. The noses easily snap into the openings and retain the functional module 3 in the module retainer 1. By applying a sufficient force to the functional module 3 in a direction away from the module retainer 3, for example at the cut out 17, the retaining elements 15 and the complementary retaining elements 32 can be disengaged in order to remove the functional module 3 from the module retainer 1 again.

While openings are used as the retaining elements 15 and noses are used as the complementary retaining elements 32 in the embodiment shown, it is noted that openings and noses can be used the opposite way round. Also other snap-in elements, like indents or notches and undercuts, can be used as the retaining or complementary retaining elements. Furthermore, also locking elements that do not snap-in, like screws or bayonet-couplings, can be applied. Generally, all elements that are suited to securely fix the functional module in the module retainer can be used as the retaining and/or complementary retaining elements.

When the functional module 3 is inserted in the module retainer 1, the functional module 3 fills the space that is needed to bend the snap-fits 12 inwards and thus obstructs the snap-fits 12. Accordingly, the clamp 20 cannot be released from the closed position anymore and the module retainer 1 and thus the functional module 3 are securely attached to the supporting belt 2. Advantageously, due to the matching shapes of the functional module 3 and the module retainer 1 in the vicinity of the snap-fits 12, no additional mechanical elements are necessary for obstructing the snap-fits 12.

Figure 4:
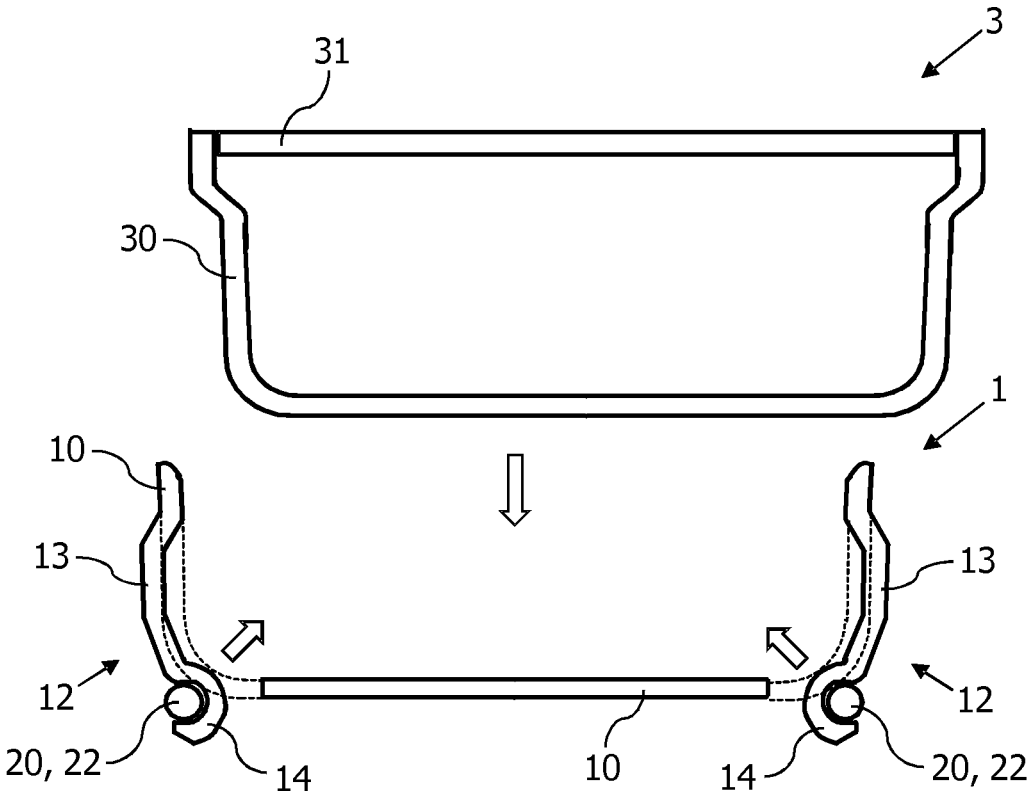
FIG. 4 shows a sectional view of a second embodiment of a module retainer and a functional module.
Figure 5:
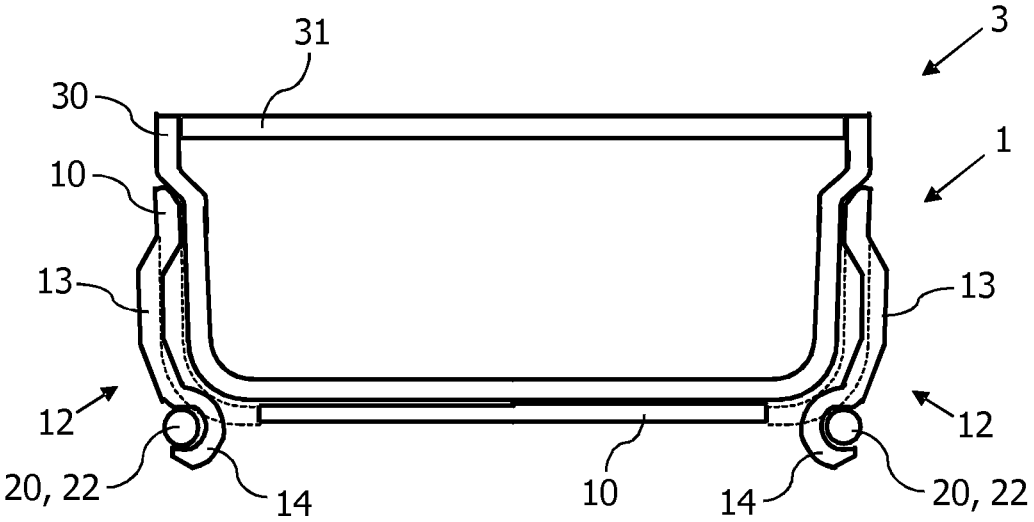
FIG. 5 shows the module retainer according to FIG. 4 with the functional module inserted.

In the following FIGS. 4 and 5, the obstruction of the snap-fits 12 is shown in more detail in sectional viewings of a second embodiment of a system of a module retainer 1 and a functional module 3. FIGS. 4 and 5 use the same reference numbers as FIGS. 1 to 3 for identical elements or elements with a comparable function.

The second embodiment of the module retainer 1 and the functional module 3 mainly corresponds to the first embodiment shown in FIGS. 1 to 3, the difference being a curved transition between the base and the side walls of the main structure 10 of the module retainer 1. Similarly, the sides and the bottom of the housing 30 of the functional module 3 show a curved transition.

FIG. 4 depicts a situation analogous to FIG. 2 in which the function module 3 is positioned above but not inserted into the module retainer 1. The clamp 20 is in the closed position with the second side 22 snapped in the notches 14 of the snap-fits 12. However, for enhanced clarity of the illustration, a supporting belt is not shown both in FIG. 4 and FIG.

5. Both FIGS. 4 and 5 show sectional views through the snap-fits 12. For clarity, the run of the side wall and the base of the main structure 10 in the section between the snap-fits 12 and the bearing 11 (i.e. behind the drawing plane) are shown by dashed lines.

Due to the cut-outs in the side wall and the base of the main structure 10, the snap-fits 12, and in particular the notches 14, are free to move inwards as indicated by the arrows in order to engage with or disengage from the second side 22 of the clamp 20.

FIG. 5 shows a situation in which the functional module 3 is inserted in the module retainer 1. As apparent from this figure, the functional module 3 now fills the space required for the snap-fits 12 to be operated. As a result, the elastic parts 13 and the notches 14 of the snap-fits 12 cannot be bent inwards and the clamp 20 is fixed in the closed position by the notches 14. The engagement can not be released, neither by applying force from the side onto the snap-fits 12, for example by pressing the elastic parts 13 with the finger tips, nor by a force applied on the base of the main structure 10 of the module retainer 1, for example by inflating the cuff used as the belt or supporting the belt in a blood pressure monitor.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A module retainer for accommodating a functional module, the module retainer comprising:

a clamp configured for attaching the module retainer to a supporting belt, the clamp including a first side pivotally attached to a main structure of the module retainer to pivot between an open position and a closed position in which the belt is embraced; and at least one snap-fit configured to attach a second side of the clamp to the main structure of the module retainer and fix the clamp in the closed position in which the supporting belt is embraced, wherein the snap-fit defines a surface configured to contact a functional element and obstruct the snap-fit from releasing the clamp from the closed position in response to a functional element being inserted in the main structure of the module retainer to secure the clamp in the closed position securing the module retainer to the supporting belt.

2. The module retainer according to claim 1, wherein the main structure comprises side walls and a base, the side walls and the base enclosing a volume for accommodating an inserted functional module.

3. The module retainer according to claim 1, wherein the at least one snap-fit comprises an elastic part and a notch attached to the elastic part for engaging with the clamp.

4. The module retainer according to claim 3, wherein the elastic part of the at least one snap-fit is a flat tongue that is aligned with a side wall of the main structure.

5. The module retainer according to claim 1, wherein the clamp is a bent U-shaped wire.

6. The module retainer according to claim 1, further comprising at least one retaining element for retaining an inserted functional module.

7. The module retainer according to claim 2, wherein an opening for connecting an inserted functional module is provided in at least one of the side walls of the main structure.

8. A system comprising:

a functional module;

a module retainer according to claim 1, including a main structure configured to accommodate the functional module and the clamp and the snap-fit for clamping the module retainer to a supporting belt; and wherein the functional module is configured to obstruct the snap-fit when inserted in the module retainer.

9. The system according to claim 8, wherein the functional module fills a moving space utilized for an operation of the at least one snap-fit when it is inserted in the module retainer.

10. A modular retainer comprising:

a main structure configured to retain a functional module therein;

a clamp element pivotally attached on one end to the main structure and movable between an open configuration to receive a belt and a closed position in which the belt is clamped between the main structure and the clamp element;

a snap-fit structure resiliently biased to a first position which fixes the clamp element in the closed position and movable to a second position which releases the clamp element to pivot from the closed position to the open configuration, the snap-fit structure being mounted in the main structure and defining a surface configured to contact a retained functional module and block the snap-fit structure from moving from the first position to the second position.

11. The modular retainer according to claim 10 wherein the snap-fit structure is integral with the main structure.

12. A modular retainer for accommodating a functional module, the module retainer comprising:

a clamp configured for attaching the module retainer to a supporting belt, the clamp having a first side that is pivotally attached to a main structure of the module retainer; and at least one snap-fit comprising an elastic part and a notch attached to the elastic part and configured for attaching with a second side of the clamp for operably attaching the second side of the clamp to the main structure of the module retainer and fixing the clamp in a closed position in which the supporting belt is embraced, and wherein the elastic part of the at least one snap fit is a flat tongue integral with the side wall of the main structure and aligned with a side wall of the main structure, and wherein the snap-fit is configured and positioned such that the snap-fit:

is obstructed from being released by a functional module inserted in the main structure of the module retainer, and secures the clamp in the closed position to secure the module retainer to the supporting belt.

13. The modular retainer according to claim 1, wherein the snap-fit is integral with the main structure.

* * * * *